US006209154B1

(12) United States Patent
Huang

(10) Patent No.: US 6,209,154 B1
(45) Date of Patent: Apr. 3, 2001

(54) MULTIPLE-STAGE POSITIONER FOR FURNITURE

(76) Inventor: Yi-Chen Huang, No. 10, Min-Sheng S. Rd., Hsi Dist., Chia-Yi City (TW)

( * ) Notice: Subject to any disclaimer, the term of this patent is extended or adjusted under 35 U.S.C. 154(b) by 0 days.

(21) Appl. No.: 09/520,301

(22) Filed: Mar. 7, 2000

(51) Int. Cl.[7] ..... A47C 17/17; A47C 17/04
(52) U.S. Cl. ..... 5/37.1; 297/354.13
(58) Field of Search ..... 5/37.1, 47, 48; 297/354.13, 360, 366

(56) References Cited

U.S. PATENT DOCUMENTS 5,960,491 * 10/1999 Olender ..... 5/57.1

* cited by examiner

*Primary Examiner*—Alexander Grosz
(74) *Attorney, Agent, or Firm*—Sheridan Ross P.C.

(57) ABSTRACT

A multiple-stage positioner includes a stationary first part, a second part connected pivotally to the stationary first part, a holding pin projecting from the first part, a positioning piece having a lower edge formed with a plurality of first grooves, a spring urging the positioning piece against the holding pin, and a guiding piece having a bottom edge substantially flush with the lower edge of the positioning piece. The bottom edge has a plurality of second grooves and groove-free parts between adjacent ones of the second grooves. The guiding piece is slidable between a first position, in which the second grooves are aligned respectively with the first grooves to receive the holding pin, and a second position, in which the groove-free parts are aligned respectively with the first grooves to prevent the holding pin from entering into the first grooves.

9 Claims, 6 Drawing Sheets

MULTIPLE-STAGE POSITIONER FOR FURNITURE

BACKGROUND OF THE INVENTION

1. Field of the Invention

This invention relates to a multiple-stage positioner, more particularly to a multiple-stage positioner for a sofa-bed.

2. Description of the Related Art

Convertible furniture, such as sofa-bed, can serve as a sofa or as a bed, and is thus capable of making efficient use of available space. It is particularly suited for rooms having limited spaces. A conventional sofa-bed normally includes a seat frame, a back frame connected pivotally to the seat frame, and a positioner that allows the back frame to be turnable relative to the seat frame. However, most of the positioners used in the conventional sofa-beds are normally disadvantageous in that they only allow the back frame to be positioned at an inclined position about the seat frame when the sofa-bed is converted from bed to sofa, and thus lack flexibility to permit the back frame to be positioned at different inclined positions.

SUMMARY OF THE INVENTION

Therefore, the object of the present invention is to provide a multiple-stage positioner that is capable of overcoming the aforementioned problem.

Another object of the present invention is to provide a piece of furniture that incorporates the multiple-stage positioner.

According to one aspect of this invention, a multiple-stage positioner comprises: a stationary first part having front and rear ends; a second part connected pivotally to the rear end for turning relative to the stationary first part; a holding pin projecting from the first part in a direction substantially parallel to the axis of rotation of the second part; an elongated positioning piece disposed below the first and second parts and having front and rear ends, and a lower edge extending forwardly from the rear end of the positioning piece across the holding pin to the front end of the positioning piece, the lower edge having a plurality of aligned and spaced apart first grooves, the rear end of the positioning piece being connected movably to the second part, the positioning piece being capable of moving forward and downward, or rearward and upward upon turning movement of the second part, the first grooves moving past the holding pin when the positioning piece moves rearward and upward, the first grooves engaging the holding pin and locking the positioning piece against forward movement; a spring mounted on the second part adjacent to the rear end of the positioning piece to urge the positioning piece against the holding pin; and a guiding piece mounted slidably and longitudinally on the positioning piece, the guiding piece having a bottom edge substantially flush with the lower edge of the positioning piece, the bottom edge having a plurality of aligned and spaced apart second grooves, and groove-free parts between adjacent ones of the second grooves, the guiding piece being slidable relative to the positioning piece between a first position, in which the second grooves are aligned respectively with the first grooves to receive the holding pin, when the positioning piece moves rearward and upward, and a second position, in which the groove-free parts are aligned respectively with the first grooves to prevent the holding pin from entering into the first grooves and to avoid the positioning piece from being locked against forward movement when the positioning piece moves forward and downward.

According to another aspect of the present invention, a piece of furniture comprises: a furniture frame, and at least one multiple-stage positioner mounted on the furniture frame. The multiple-stage positioner includes: a stationary first part having front and rear ends, and a fixed support projecting downward from the rear end; a second part having one end connected pivotally to the rear end of the first part for turning between an unfolded position in which the second part is coplanar with the first part, and a folded position in which the second part turns upward relative to the first part, the second part having a bracket projecting downwardly from the second part in the unfolded position; a holding pin projecting from the support in a direction substantially parallel to the axis of rotation of the second part; an elongated positioning piece disposed below the first and second parts and having a front end, a rear end opposite to the front end and connected movably to the bracket, and a lower edge extending forwardly from the rear end of the positioning piece across the holding pin to the front end of the positioning piece, the positioning piece being capable of moving forward and downward, or rearward and upward upon movement of the second part between the unfolded and folded positions, the lower edge being notched to form pin abutment edge parts, sliding edge parts, and a plurality of aligned and spaced part first grooves, each of which is confined by one of the pin abutment edge parts and one of the sliding edge parts, the pin abutment edge parts facing toward the front end of the positioning piece, the sliding edge parts facing toward the rear end of the positioning piece, each of the sliding edge parts being inclined relative to the lower edge with an angle smaller than that formed between each of the pin abutment edge parts and the lower edge, the first grooves moving past the holding pin when the positioning piece moves rearward and upward, the first grooves engaging the holding pin and locking the positioning piece against forward movement, the lower edge of the positioning piece further having a first groove half formed anteriorly of the first grooves; a spring mounted on the bracket adjacent to the rear end of the positioning piece to urge the positioning piece against the holding pin; and a guiding piece juxtaposed and mounted slidably on the positioning piece, the guiding piece having a bottom edge substantially flush with the lower edge of the positioning piece, the bottom edge having a plurality of aligned and spaced apart second grooves, and groove-free parts between adjacent ones of the second grooves, the guiding piece being slidable relative to the positioning piece between a first position, in which the second grooves are aligned respectively with the first grooves to receive the holding pin, and a second position, in which the groove-free parts are aligned respectively with the first grooves to prevent the holding pin from entering into the first grooves, the bottom edge of the guiding piece further having a second groove half formed anteriorly of the second grooves, and a frontmost pin-engaging edge part disposed anteriorly of the second groove half, the first and second groove halves opposing and complementing one another for cooperatively receiving the holding pin when the guiding piece is in the first position, the second groove half being slidable over the holding pin, the first groove half being engageable with the holding pin, the pin-engaging edge part having a depth smaller than that of the second groove half from the bottom edge and being engageable with the holding pin immediately after the second groove half slides rearwardly past the holding pin.

BRIEF DESCRIPTION OF THE DRAWINGS

In drawings which illustrate an embodiment of the invention.

DETAILED DESCRIPTION OF THE PREFERRED EMBODIMENT

Figure 1:
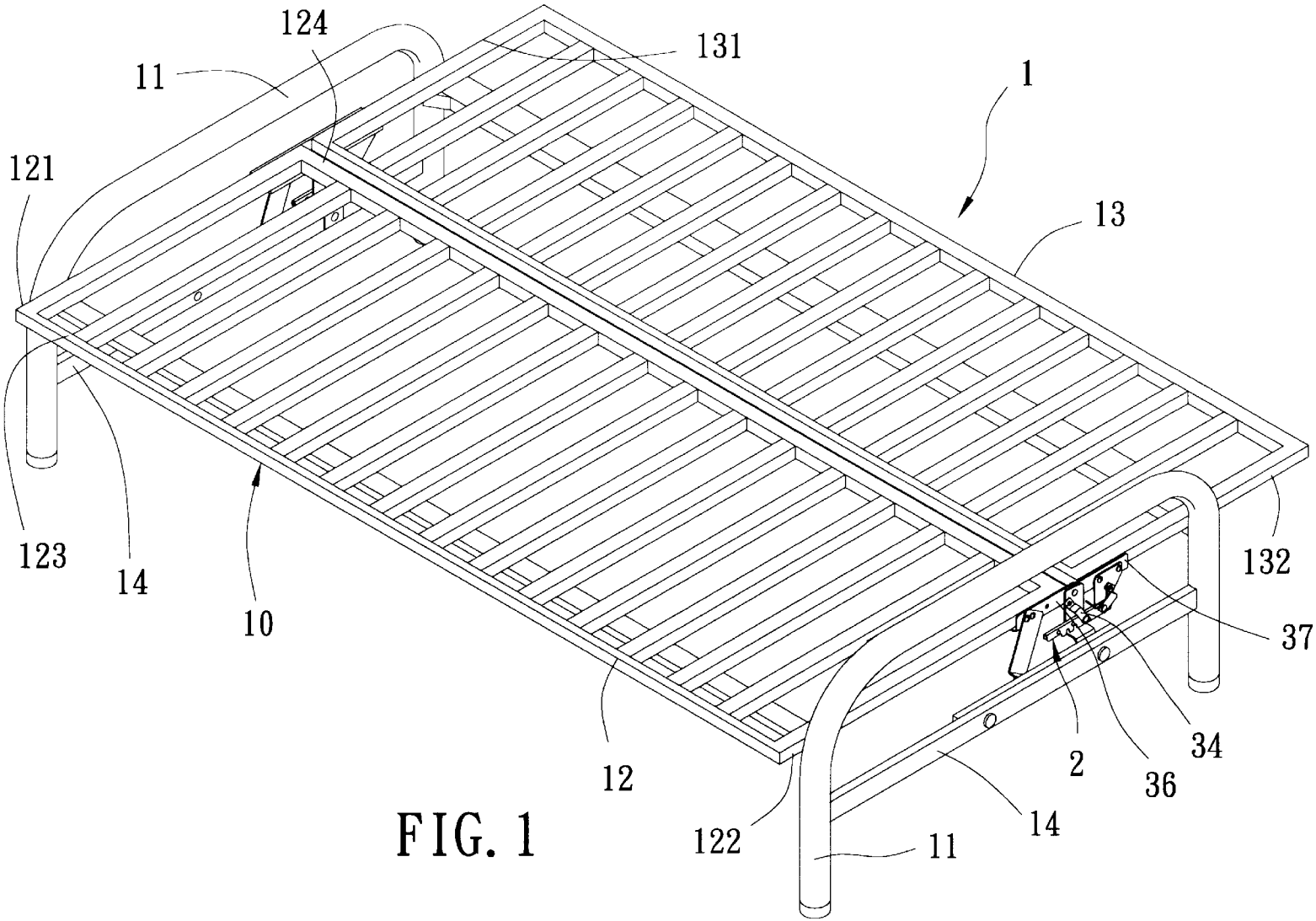
FIG. 1 is a schematic view of a convertible sofa-bed with a multiple-stage positioner embodying this invention.
Figure 2:
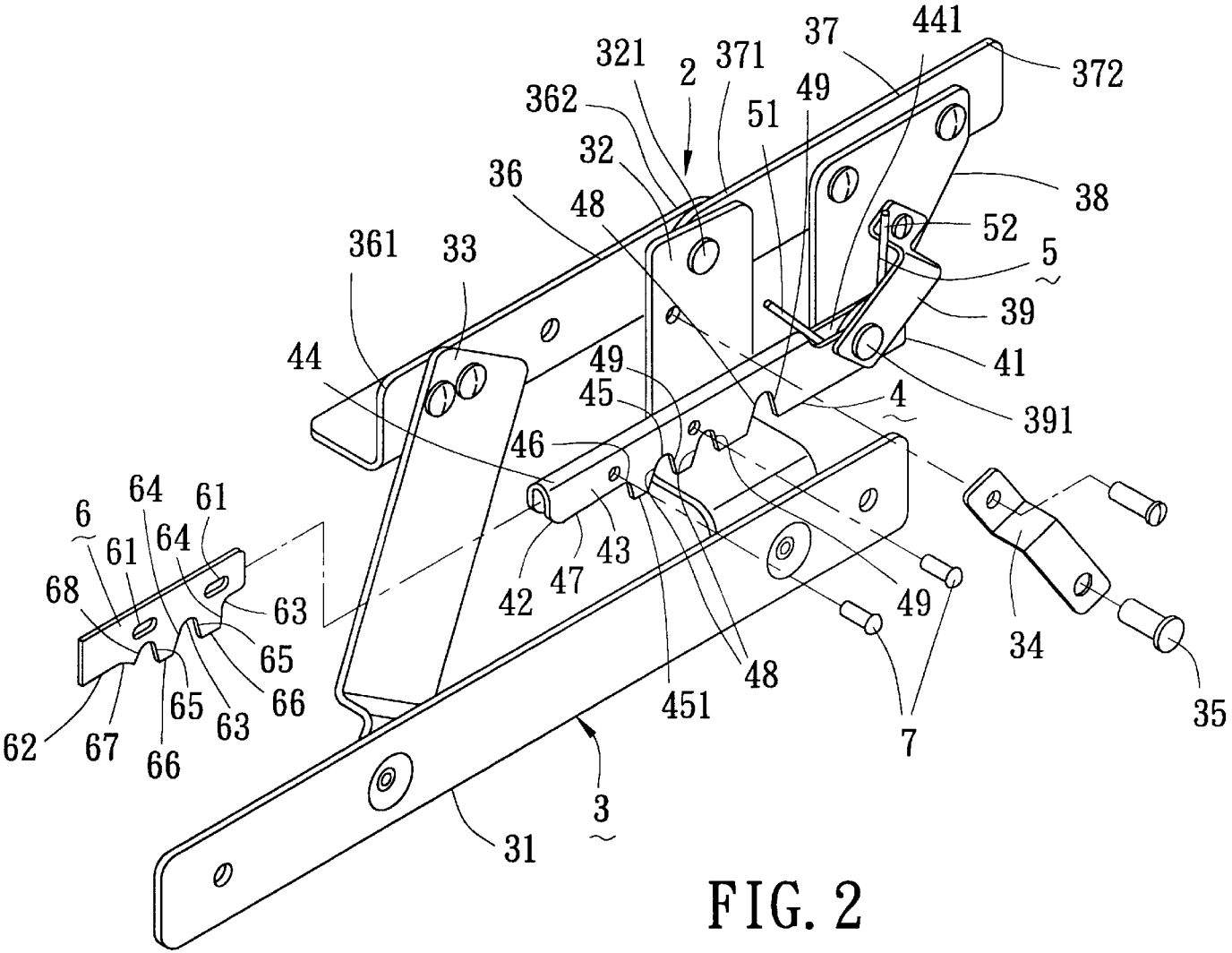
FIG. 2 is a partly exploded view of the multiple-stage positioner of FIG. 1.
Figure 3:
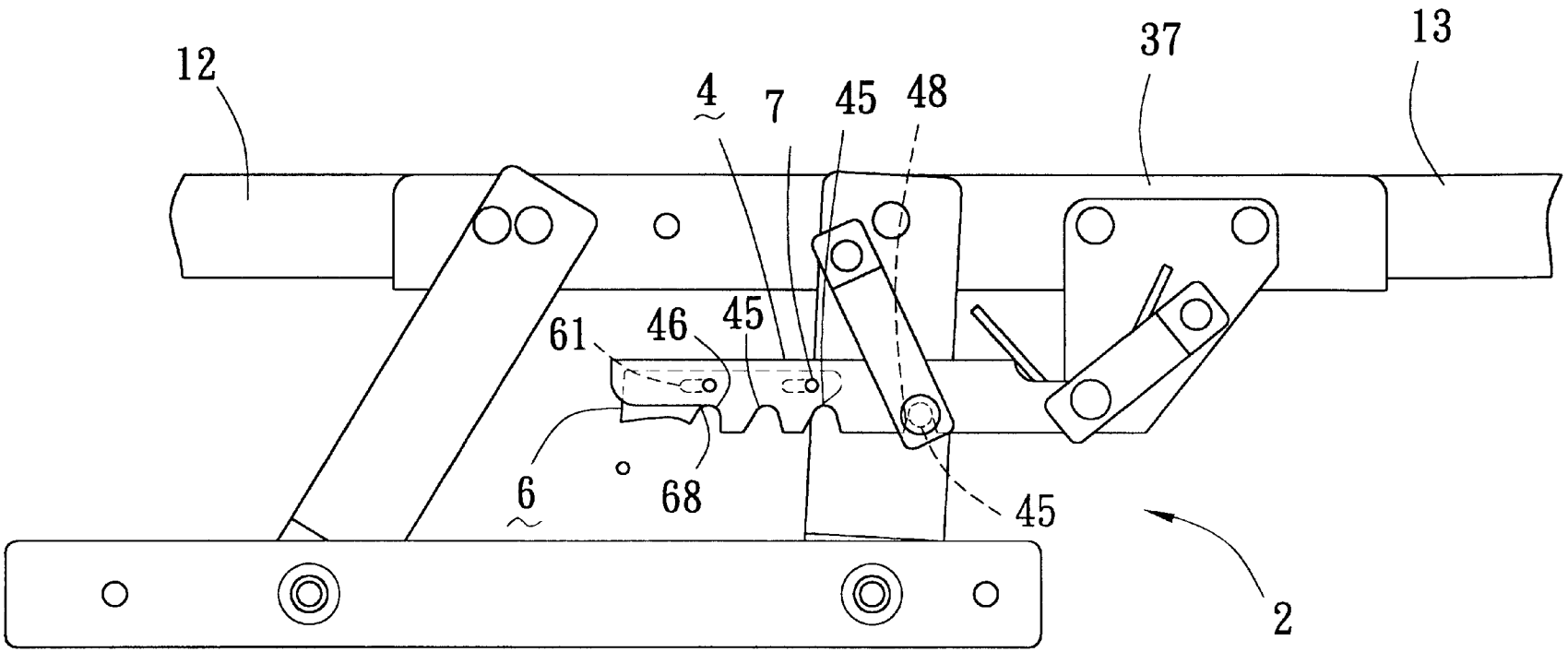
FIG. 3 is a side view of the multiple-stage positioner of FIG. 1 with the positioning piece in an unfolded position.
Figure 4:
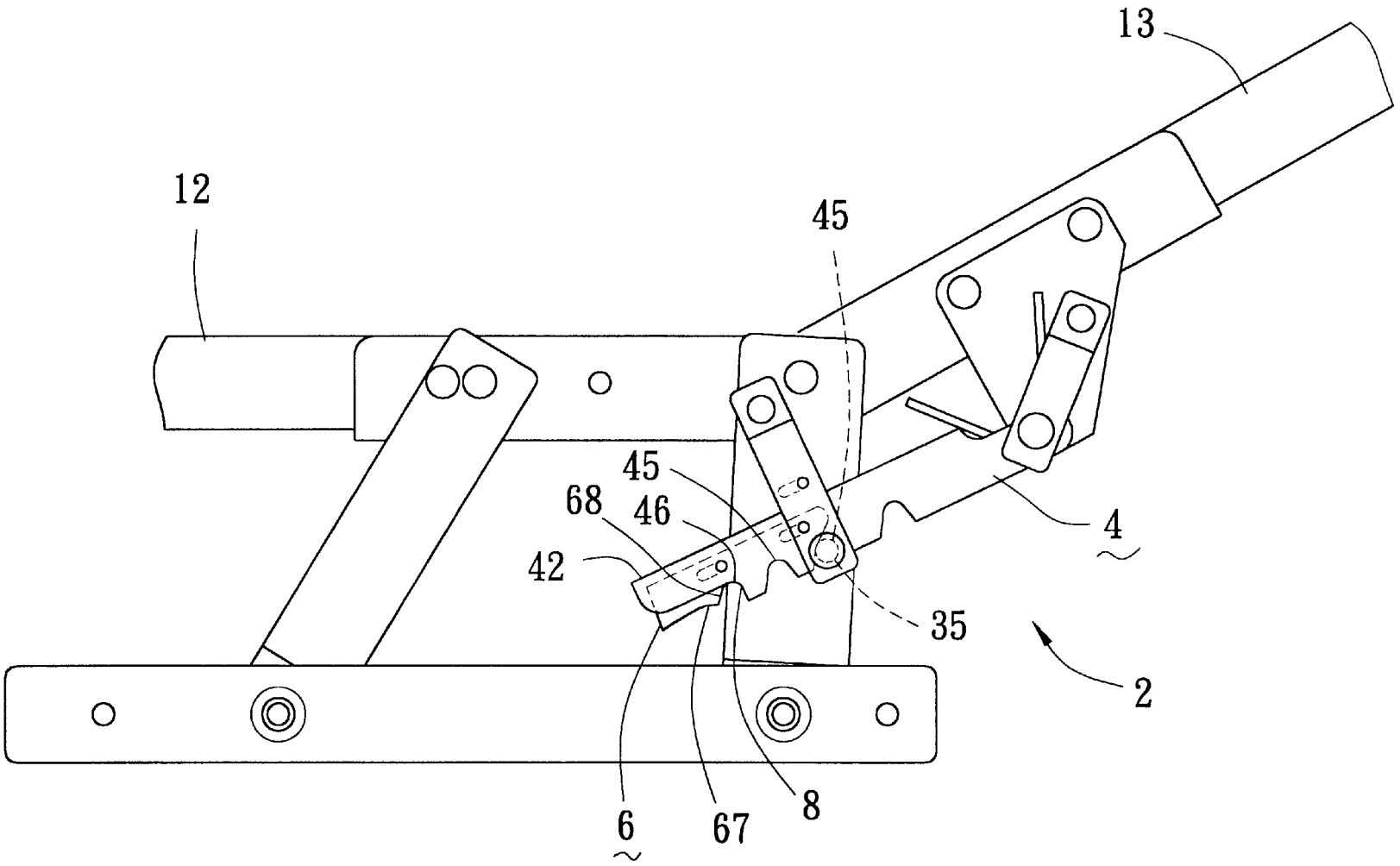
FIG. 4 is a side view of the multiple-stage positioner of FIG. 1 with the positioning piece in a folded position.
Figure 5:
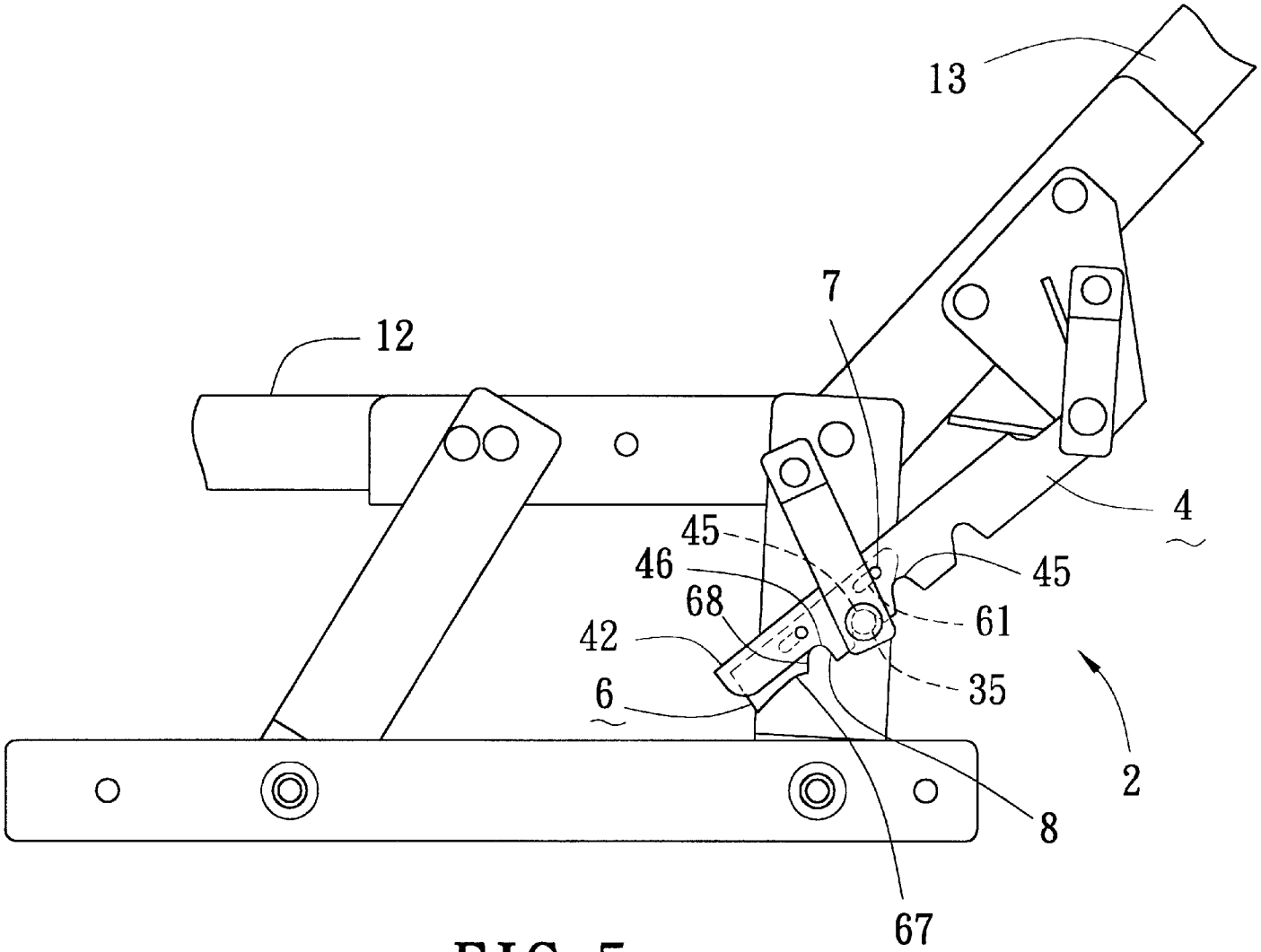
FIG. 5 is a side view of the multiple-stage positioner of FIG. 1 with the positioning piece in another folded position.
Figure 6:
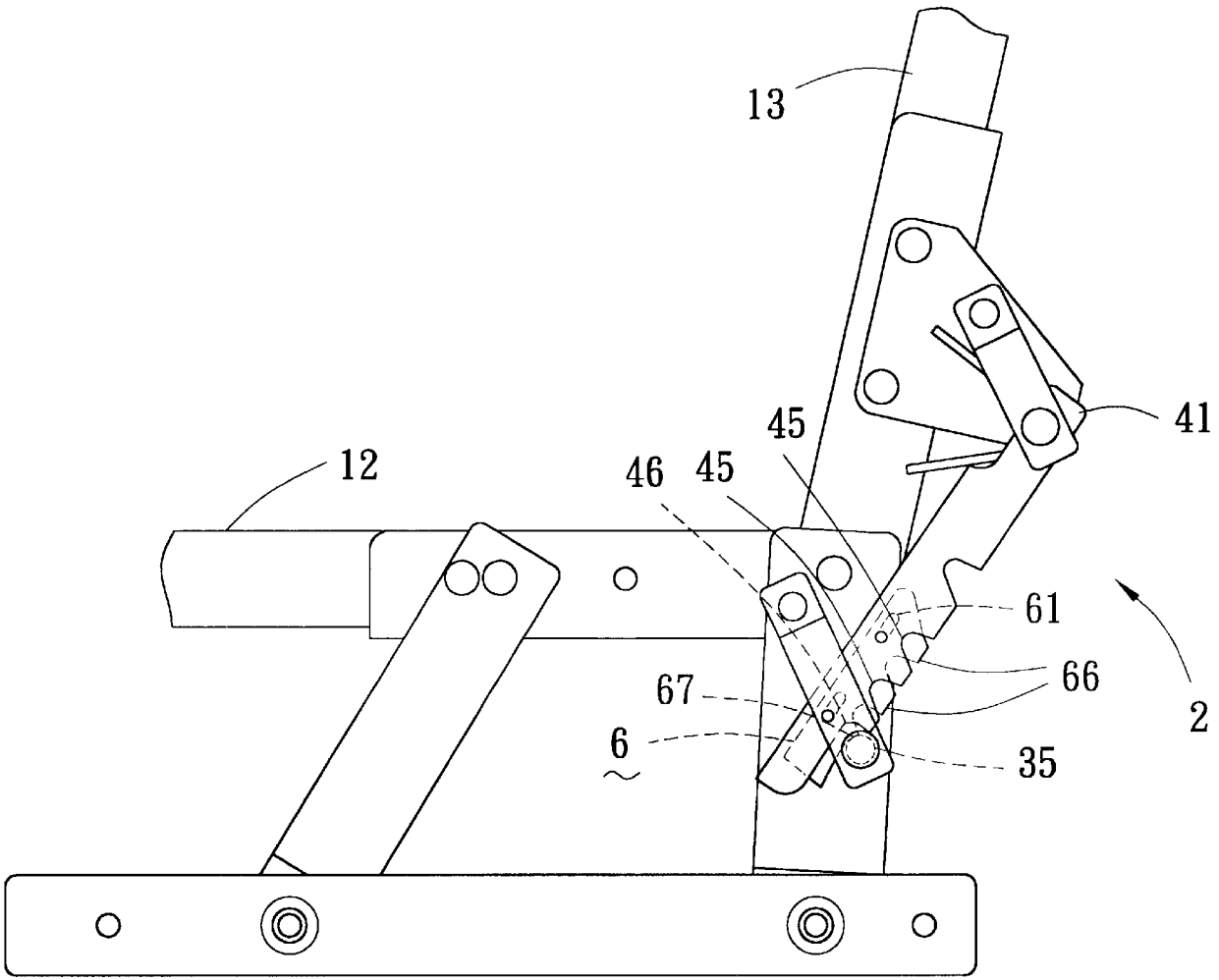
FIG. 6 is a side view of the multiple-stage positioner of FIG. 1 with the guiding piece in a second position which permits retraction of the positioning piece to the unfolded postition.

FIGS. 2 to 6 illustrate a multiple-stage positioner 2 embodying this invention. FIG. 1 illustrates a convertible sofa-bed 1 that has two opposite sides, each of which is attached with one multiple-stage positioner 2. The sofa-bed 1 has a furniture frame 10 which includes a seat frame 12 having left and right sides 121, 122 and front and rear ends 123, 124, a back frame 13 disposed posteriorly of and connected pivotally to the rear end 123 of the seat frame 12 via the multiple-stage positioners 2 and having left and right sides 131, 132, left and right leg frames 11 connected respectively to the left sides 121, 131 of the seat and back frames 12, 13 and the right sides 122, 132 of the seat and back frames 12, 13, and left and right cross bars 14 extending respectively across the left and right leg frames 11 in a front-to-rear direction below the seat and back frames 12, 13.

Each of the multiple-stage positioners 2 includes a stationary positioning frame 3, an elongated positioning piece 4 having opposite front and rear ends 42, 41, a torsion spring 5 having two opposite end sections 51, 52, and a guiding piece 6.

The stationary positioning frame 3 has a stationary first part 36 secured to one of the left and right sides 121, 122 of the seat frame 12 and having front and rear ends 361, 362, a second part 37 secured to one of the left and right sides 131, 132 of the back frame 13 and having front and rear ends 371, 372, a fixing plate 31 disposed longitudinally below the seat and back frames 12, 13 and attached securely to one of the left and right cross bars 14 at one side, an L-shaped primary fixed support 32 connected to and projecting downwardly from the rear end 362 of the first part 36 and having one end that is connected securely to the fixing plate 31 and that projects laterally therefrom, and an auxiliary fixed support 33 interconnecting securely the front end 361 of the first part 36 and the fixing plate 31. The front end 371 of the second part 37 is disposed between and is connected pivotally to the rear end 362 of the first part 36 and the fixed support 32 via a pivot pin 321 extending through the fixed support 32, the front end 371 of the second part 37, and the rear end 362 of the first part 36. The second part 37 is thus rotatable about an axis defined by the pivot pin 321, and is turnable between an unfolded position where the second part 37 is coplanar with the first part 36, and a folded position where the second part 37 turns upward relative to the first part 36. A bracket 38 is secured to the second part 37, and projects downwardly therefrom in the unfolded position. An L-shaped limit plate 39 has two opposite ends interconnecting respectively the bracket 38 and the rear end 41 of the positioning piece 4. A holding pin 35 projects outwardly from the primary fixed support 32 in a direction substantially parallel to the axis of rotation of the second part 37.

The positioning piece 4 is disposed below the first and second parts 36, 37 and above the fixing plate 31, and further has a lower edge 47 extending from the rear end 41 across the holding pin 35 and the primary fixed support 32 to the front end 42 thereof. The rear end 41 of the positioning piece 4 is disposed between and is connected pivotally to the bracket 38 and one of the opposite ends of the limit plate 39 via a pivot pin 391 extending through the limit plate 39, the rear end 41 of the positioning piece 4, and the bracket 38 so that the positioning piece 4 is capable of moving forward and downward, or rearward and upward upon movement of the second part 37 between the folded and unfolded positions. The lower edge 47 of the positioning piece 4 is notched to form a plurality of aligned first grooves 45, and a plurality of first groove-free parts 451 spaced apart respectively by the first grooves 45. Each of the first grooves 45 is confined by opposite sliding and pin abutment edge parts 48, 49 which face respectively toward the rear and front ends 41, 42 of the positioning piece 4. Each of the sliding edge parts 48 is inclined relative to the lower edge 47 with an angle smaller than that formed between each of the pin abutment edge parts 49 and the lower edge 47. The sliding edge parts 48 permit the first grooves 45 to move past the holding pin 35, when the positioning piece 4 moves rearward and upward. The pin abutment edge parts 49 engage the holding pin 35 and thus lock the positioning piece 4 against forward movement. A first groove half 46 is formed in the lower edge 47 anteriorly of the first grooves 45 and of the first groove-free parts 451 adjacent to the front end 42 of the positioning piece 4, and is engageable with the holding pin 35 to prevent the positioning piece 4 from moving frontward and downward. The positioning piece 4 is formed as a channel piece which opens downwardly and which has two opposite sides 43 and a top side 44 interconnecting the opposite sides 43. A top opening 441 is formed in the top side 44 of the positioning piece 4 adjacent to the rear end 41 of the positioning piece 4. An L-shaped retaining plate 34 has one end connected to the primary fixed support 32 at the holding pin 35, and the other end secured to the primary fixed support 32 above the holding pin 35. The positioning piece 4 extends between the primary fixed support 32 and the retaining plate 34.

The torsion spring 5 is mounted on the pivot pin 391 between the opposite sides 43, 44 of the positioning piece 4. The opposite end sections 51, 52 of the torsion spring 5 project upwardly from the pivot pin 391 through the top opening 441 in the positioning piece 4 so as to abut respectively against the top side 44 of the positioning piece 4 and the limit plate 39 and to urge the positioning piece 4 against the holding pin 35.

The guiding piece 6 is juxtaposed and is mounted slidably on the positioning piece 4 adjacent to the front end 42 of the positioning piece 4. The guiding piece 6 is in the form of a longitudinally extending plate, and has a bottom edge 62 which is substantially flush with the lower edge 47 of the positioning piece 4. The bottom edge 62 of the guiding piece 4 is notched to form a plurality of aligned second grooves 63 and a plurality of second groove-free parts 66 spaced apart respectively by the second grooves 63. The second grooves 63 substantially conform to the first grooves 45. A second groove half 68 is formed in the bottom edge 62 anteriorly of the second groove-free parts 66 and of the first groove half 46. A frontmost pin-engaging edge part 67 is formed in the bottom edge 62 anteriorly of the second groove half 68. The pin-engaging edge part 67 has a depth smaller than that of the second groove half 68 from the bottom edge 62. The guiding piece 6 further includes two opposite spaced apart slots 61 which are elongated and are aligned in the longitudinal direction of the positioning piece 4. Two mounting pins 7 extend respectively into the slots 61 from the positioning piece 4 so that the guiding piece 6 is capable of sliding relative to the positioning piece 4 between a first position, where the second grooves 63 are aligned respectively with the first grooves 45 and where the first and second groove halves 46, 68 are opposed to and complement one another to form a frontmost third groove 8 for receiving the holding pin 35 in one of the first grooves 45 and the frontmost third groove 8, and a second position, where the second groove-free parts 66 are aligned respectively with the first grooves 45 and where the second groove half 68 is aligned with the first groove half 46 for preventing the holding pin 35 from entering into the first grooves 45 and the third groove 8. The second half groove 68 is slidable over the holding pin 35 when the positioning piece 4 moves rearward and upward. The pin-engaging edge part 67 is engageable with the holding pin 35 so as to place the guiding piece 6 in the second position from the first position by moving the positioning piece 4 frontward and downward after the second groove half 68 slides past the holding pin 35 in the course of the rearward and upward movement of the positioning piece 4. After the pin-engaging edge part 67 is slid frontward over the holding pin 35 by moving the second part 37 rearward and downward when the guiding piece 6 is in the second position, the guiding piece 6 will not be held by the holding pin 35 any longer, and the guiding piece 6 will thus slide downward from the second position to the first position by virtue of gravity. Therefore, in order to move the second part 37 from the folded position to the unfolded position and to allow the rearmost one of the first grooves 45 to engage the holding pin 35, a quick frontward movement of the positioning piece 4 is necessary before the guiding piece 6 slides to the first position.

With the multiple-stage positioner 2, the sofa-bed 1 of this invention can be converted from a bed to a sofa which permits the back frame 13 to be inclined relative to the seat frame 12 at different angles.

With the invention thus explained, it is apparent that various modifications and variations can be made without departing from the spirit of the present invention. It is therefore intended that the invention be limited only as recited in the appended claims.

I claim:

1. A multiple-stage positioner for a piece of furniture, comprising:

a stationary first part having front and rear ends;

a second part connected pivotally to said rear end for turning relative to said stationary first part;

a holding pin projecting from said first part in a direction substantially parallel to axis of rotation of said second part;

an elongated positioning piece disposed below said first and second parts and having front and rear ends, and a lower edge extending forwardly from said rear end of said positioning piece across said holding pin to said front end of said positioning piece, said lower edge having a plurality of aligned and spaced apart first grooves, said rear end of said positioning piece being connected movably to said second part, said positioning piece being capable of moving forward and downward, or rearward and upward upon turning movement of said second part, said first grooves moving past said holding pin when said positioning piece moves rearward and upward, said first grooves engaging said holding pin and locking said positioning piece against forward movement;

a spring mounted on said second part adjacent to said rear end of said positioning piece to urge said positioning piece against said holding pin; and a guiding piece mounted slidably and longitudinally on said positioning piece, said guiding piece having a bottom edge substantially flush with said lower edge of said positioning piece, said bottom edge having a plurality of aligned and spaced apart second grooves, and groove-free parts between adjacent ones of said second grooves, said guiding piece being slidable relative to said positioning piece between a first position, in which said second grooves are aligned respectively with said first grooves to receive said holding pin, when said positioning piece moves rearward and upward, and a second position, in which said groove-free parts are aligned respectively with said first grooves to prevent said holding pin from entering into said first grooves and to avoid said positioning piece from being locked against forward movement when said positioning piece moves forward and downward.

2. The multiple-stage positioner of claim 1, wherein said lower edge of said positioning piece further has a first groove half formed anteriorly of said first grooves, said bottom edge of said guiding piece further having a second groove half which is formed anteriorly of said second grooves and said first groove half, and a frontmost pin-engaging edge part disposed anteriorly of said second groove half, said second groove half and said first groove half opposing and complementing one another for cooperatively receiving said holding pin when said guiding piece is in said first position, said pin-engaging edge part being engageable with said holding pin so as to place said guiding piece in said second position from said first position after said second groove half slides past said holding pin in the course of the rearward and upward movement of said positioning piece, said second groove half being aligned with said first groove half when said guiding piece is in said second position.

3. The multiple stage positioner of claim 2, wherein each of said first grooves is confined by a pin abutment edge part which is formed in said lower edge to face toward said front end of said positioning piece, and a sliding edge part which is formed in said lower edge opposite to said pin abutment edge part and which is slidable over said holding pin when said positioning piece moves rearward and upward, said sliding edge part being inclined relative to said lower edge with an angle smaller than that formed between said pin abutment edge part and said lower edge, said second grooves substantially conforming to said first grooves.

4. A piece of furniture comprising:

a furniture frame; and at least one multiple-stage positioner mounted on said furniture frame, said multiple-stage positioner including:

a stationary first part having front and rear ends, and a fixed support projecting downward from said rear end;

a second part having one end connected pivotally to said rear end of said first part for turning between an unfolded position in which said second part is coplanar with said first part, and a folded position in which said second part turns upward relative to said first part, said second part having a bracket projecting downwardly from said second part in said unfolded position;

a holding pin projecting from said support in a direction substantially parallel to axis of rotation of said second part;

an elongated positioning piece disposed disposed below said first and second parts and having a front end, a rear end opposite to said front end and connected movably to said bracket, and a lower edge extending forwardly from said rear end of said positioning piece across said holding pin to said front end of said positioning piece, said positioning piece being capable of moving forward and downward, or rearward and upward upon movement of said second part between said unfolded and folded positions, said lower edge being notched to form pin abutment edge parts, sliding edge parts, and a plurality of aligned and spaced part first grooves, each of which is confined by one of said pin abutment edge parts and one of said sliding edge parts, said pin abutment edge parts facing toward said front end of said positioning piece, said sliding edge parts facing toward said rear end of said positioning piece, each of said sliding edge parts being inclined relative to said lower edge with an angle smaller than that formed between each of said pin abutment edge parts and said lower edge, said first grooves moving past said holding pin when said positioning piece moves rearward and upward, said first grooves engaging said holding pin and locking said positioning piece against forward movement, said lower edge of said positioning piece further having a first groove half formed anteriorly of said first grooves;

a spring mounted on said bracket adjacent to said rear end of said positioning piece to urge said positioning piece against said holding pin; and a guiding piece juxtaposed and mounted slidably on said positioning piece, said guiding piece having a bottom edge substantially flush with said lower edge of said positioning piece, said bottom edge having a plurality of aligned and spaced apart second grooves, and groove-free parts between adjacent ones of said second grooves, said guiding piece being slidable relative to said positioning piece between a first position, in which said second grooves are aligned respectively with said first grooves to receive said holding pin, and a second position, in which said groove-free parts are aligned respectively with said first grooves to prevent said holding pin from entering into said first grooves, said bottom edge of said guiding piece further having a second groove half formed anteriorly of said second grooves, and a frontmost pin-engaging edge part disposed anteriorly of said second groove half, said first and second groove halves opposing and complementing one another for cooperatively receiving said holding pin when said guiding piece is in said first position, said second groove half being slidable over said holding pin, said first groove half being engageable with said holding pin, said pin-engaging edge part having a depth smaller than that of said second groove half from said bottom edge and being engageable with said holding pin immediately after said second groove half slides rearwardly past said holding pin.

5. The piece of furniture of claim 4, wherein said guiding piece further includes two spaced apart slots which are elongated and aligned in the longitudinal direction of said positioning piece, said positioning piece further including two mounting pins extending respectively into said slots.

6. The piece of furniture of claim 4, wherein said spring is a torsion spring disposed around a pivot axis about which said positioning piece is pivoted to said bracket, said torsion spring having two opposite end sections engaging respectively said bracket and said positioning piece.

7. The piece of furniture of claim 6, wherein said bracket includes a limit plate which has one end pivoted to said bracket at said pivot axis of said positioning piece and the other end pivoted to said bracket above said pivot axis, said limit plate projecting outwardly from said bracket between said one end and said other end of said limit plate, said positioning piece being formed as a channel piece which opens downward and which has two opposite sides extending between said bracket and said one end of said limit plate, and a top side interconnecting said two opposite sides, said top side having a top opening adjacent to said rear end of said positioning piece, said torsion spring being disposed between said two opposite sides of said channel piece, one of said end sections of said torsion spring engaging said limit plate, the other one of said end sections extending through said top opening and engaging said top side of said channel piece.

8. The piece of furniture of claim 7, wherein said support further includes a retaining plate which has one end fixed to said support at said holding pin and the other end fixed to said support above said holding pin, said positioning piece extending between said support and said retaining plate.

9. The piece of furniture of claim 4, which includes a pair of said multiple-stage positioners, wherein said furniture frame includes:

a seat frame having front and rear ends, and left and right sides;

a back frame disposed posteriorly of and connected pivotally to said rear end of said seat frame, said back frame having left and right sides;

left and right leg frames connected respectively to said left and right sides of said seat frame and of said back frame and extending downwardly from said seat and back frames; and left and right cross bars extending respectively across said left and right leg frames in a front-to-rear direction below said seat and back frames, said multiple-stage positioners interconnecting respectively said left and right sides of said seat and back frames and said left and right cross bars, said first parts of said positioners being connected respectively to said left and right sides of said seat frame, said second parts of said positioners being connected respectively to said left and right sides of said back frame, said supports of said positioners being connected rigidly and respectively to said left and right cross bars.

* * * * *